US005575033A

United States Patent [19]

Nolte

[11] Patent Number: 5,575,033

[45] Date of Patent: Nov. 19, 1996

[54] FLOOR-CLEANING APPLIANCE

[75] Inventor: Werner Nolte, Nohen, Germany

[73] Assignee: Metaform Metalliverarbeitungs-Gesellschaft mbH, Hoppstädten-Weiersbach, Germany

[21] Appl. No.: 356,371

[22] PCT Filed: Apr. 29, 1993

[86] PCT No.: PCT/EP93/01039

§ 371 Date: Dec. 27, 1994

§ 102(e) Date: Dec. 27, 1994

[87] PCT Pub. No.: WO94/24923

PCT Pub. Date: Nov. 10, 1994

[51] Int. Cl.[6] ..... A47L 13/24; B25G 1/06

[52] U.S. Cl. ..... 15/147.2; 15/144.1; 15/144.2; 15/229.6; 15/229.8

[58] Field of Search ..... 15/147.1, 147.2, 15/144.2, 144.1, 228, 229.1, 229.6–229.9

[56] References Cited

U.S. PATENT DOCUMENTS 131,674 9/1872 Fitzhugh ..... 15/147.1
1,943,479 1/1934 Hesson ..... 15/144.1
2,671,236 3/1954 Richards ..... 15/144.1
4,850,075 7/1989 Kresse ..... 15/228

*Primary Examiner*—David Scherbel
*Assistant Examiner*—Randall E. Chin
*Attorney, Agent, or Firm*—George W. Dishong

[57] ABSTRACT

The invention relates to an improved cleaning appliance used to clean floors, walls or the like, with a cardanic or semi-cardanic fastening of the handle to the basic body portion or the cleaning device which does the actual cleaning, scrubbing, wiping or other cleaning function. The invention permits the particular appliance and the handle, semi-cardanically attached thereto, to be fixed in a substantially upright position permitting it to be leaned against a fixed object and thus making the handle accessible to the user without the user or operator having to bend over to pick up the appliance. A setting-up stirrup is articulatably attached on the cleaning device and is caused to articulate by an operator thereby engaging behind a projection, screw or peg on the handle or for catching in a horizontal groove of this handle.

11 Claims, 3 Drawing Sheets

FLOOR-CLEANING APPLIANCE

FIELD OF THE INVENTION

The invention relates to a floor-cleaning appliance or the like with a cardanic or semi-cardanic fastening of the handle to the actual cleaning, scrubbing, wiping or other device.

BACKGROUND OF THE INVENTION

Modern floor-cleaning appliances, to which cloths, fringes, textile coverings or the like are attached for the actual wiping operation, usually have a cardanic or semi-cardanic suspension of their handle for the purpose of more versatile use.

This affords considerable advantages in versatility, but has the disadvantage that under no circumstances does the handle stand up by itself and further cannot even be merely leaned against something. It simply falls over and to the ground.

SUMMARY OF THE INVENTION

The object on which the invention is based is to avoid the problems mentioned above and also for other reasons. The invention permits the particular appliance and the handle attached thereto to be fixed in a substantially upright position permitting it to be leaned against a fixed object and thus making the handle accessible to the user without the user or operator having to bend over to pick up the appliance.

This object is achieved in a surprisingly simple way by means of a setting-up stirrup articulated on the cleaning device and intended for engaging behind a projection, screw or peg on the handle or for catching in a horizontal groove of this handle.

The operator therefore no longer needs to bend down to the handle lying on the floor in order to recover the cleaning appliance. Also, there is no need for separate devices to hold the cleaning appliance, i.e., holding constructions provided outside the cleaning appliance. It is sufficient to actuate the setting-up stirrup articulated, for example, on the baseplate of the cleaning appliance, in such a way that it engages behind a projection, screw, peg or the like on the handle fastening and the handle then comes to bear against the holding stirrup. The handle stands essentially freely in space, even though its foot is nevertheless articulated on the cleaning appliance cardanically, that is to say movably for substantially any conceivable degree of freedom.

According to one embodiment of the invention, it is also possible, if appropriate even without changing the shape, that the half-lug of the setting-up stirrup, which can be articulated at the same location of the baseplate of the cleaning appliance, simply falls into a horizontal groove of the handle, is pushed in or catches in the latter. The groove can also be designed as a slot or the like. In general, however, the groove will be continuous.

Preferably, the setting-up stirrup can have a tread on the side remote from the handle. This tread can have a formed-on plastic mass or, according to another embodiment, can simply consist of wire ends bent back against themselves. With regard to the joints, the half-lug part of the setting-up stirrup is arranged on one side and the tread on the other side of these joints. When the operator steps on the tread, the stirrup rises automatically, and therefore the operator does not need to bend down in order to operate it.

The half-lug part of the setting-up stirrup is expediently or advantageously bent to the rear, i.e., downward toward the base to form a support. This makes it easier for it to engage against projections of the handle or holder.

Preferably, in the longitudinal region of the setting-up stirrup, the stirrup wires are, if the bent part is supported on the base, shaped or bent in such a way that they come to rest along this base.

As a result of the particular embodiment wherein the bent part is so supported on the base and the stirrup wires rest along the base, the versatility of use of the cleaning appliance is enhanced, since it can thus also wipe under a cupboard or the like, even when a setting-up stirrup is present. In this version of the invention, similarly to the other versions, the setting-up operation is carried out using the tread.

BRIEF DESCRIPTION OF THE DRAWINGS

Exemplary embodiments of the invention will now be explained in more detail with reference to the accompanying drawings, in which.

Like parts are designated by the same reference symbols in the figures.

DESCRIPTION OF THE PREFERRED EMBODIMENTS

Figure 1:
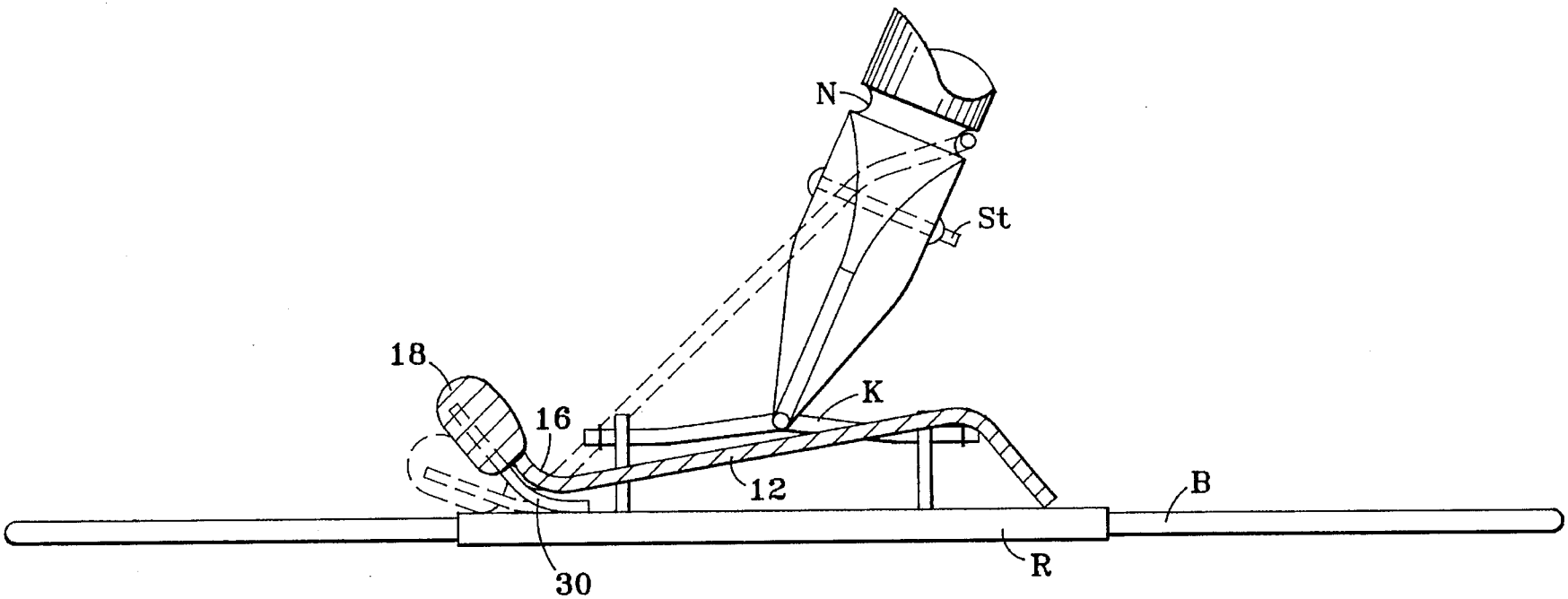
FIG. 1 shows an elevation view.
Figure 2:
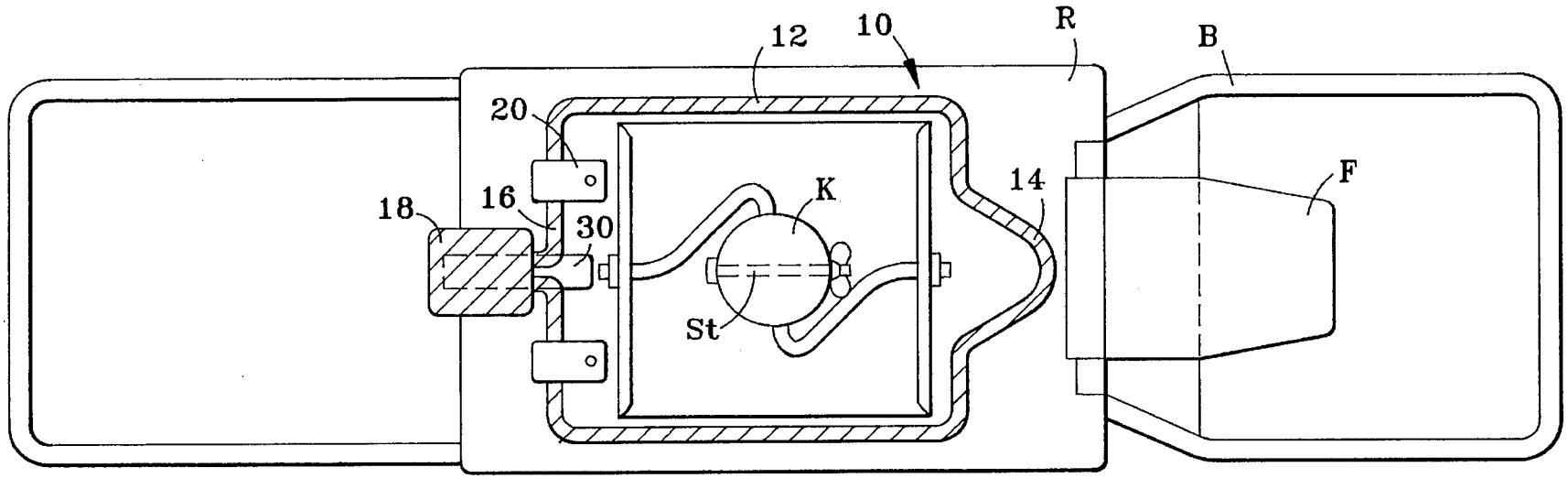
FIG. 2 shows a top view of FIG. 1.

It can be seen from FIGS. 1 and 2 how a handle with a groove N and handle fastening St is suspended cardanically on the cardan joint K. This handle would therefore fall over in any position.

The cleaning appliance is known per se and consists of a basic body R, a continuous stirrup B and a catch spring F, the function of which is to keep the parts B and R interlocked in the extended position after they have been swung into the extended position, whilst, by pressing on the catch spring F, the cleaning appliance can be released again from the textile covering surrounding it.

The setting-up stirrup 10 according to the invention has, in its basic form, the shape of an elongate rectangle with longitudinal stirrup sides 12, a transverse side with a half-lug 14 and the articulation 20 and, opposite thereto, a tread 18 on the side 16 of the setting-up stirrup located opposite the half-lug. FIG. 1 shows the setting-up stirrup in the set-up position (the foot has actuated the tread 18, caught or inserted in a groove N of the handle). When the setting-up stirrup construction 10 has done its job, it falls back out of its high position (in broken lines in FIG. 1) when the operator grasps the handle.

The half-lug 14 is angled relative to the plane formed by baseplate R.

Figure 3A:
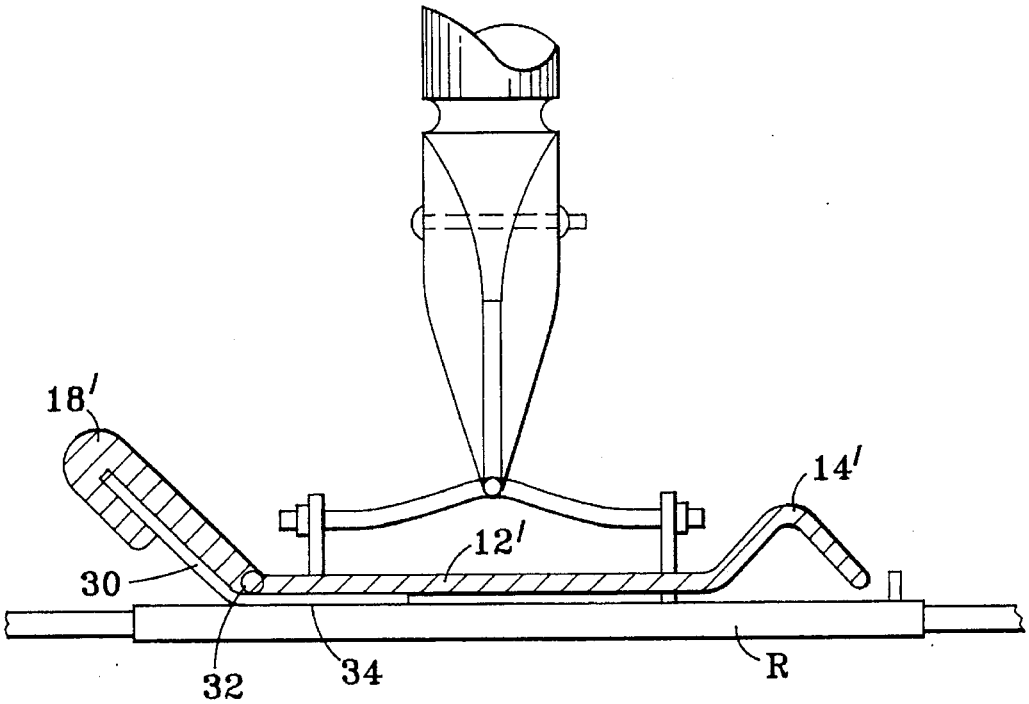
FIG. 3*a* shows one version of the extension of the stirrup and the material of the tread part.
Figure 4:
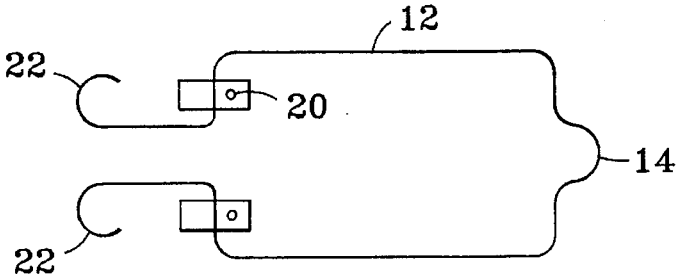
FIG. 4 shows one version of the tread part.

According to FIG. 3*a*, in this version, the longitudinal part of the setting-up stirrup 12' is designed to rest flat on the baseplate, with the result that it becomes easier, for example, to wipe under a cupboard with a broom handle. The tread 18' and the bend of the half-lug are similar to the embodiment described hitherto. According to FIG. 4, the tread is designed in such a way that the stirrup ends 22 are bent back against themselves. Other forms are possible. This form does without a plastic part. If necessary, the ends can also be looped relative to one another. The tread is once again angled relative to the plane formed by baseplate R.

As a development of the invention for a special purpose, for example for the overhead wiping or cleaning of, for example, ceilings, there is provided a measure which prevents the setting-up stirrup 10 from falling downwards and from restricting the freedom of movement.

Figure 3B:
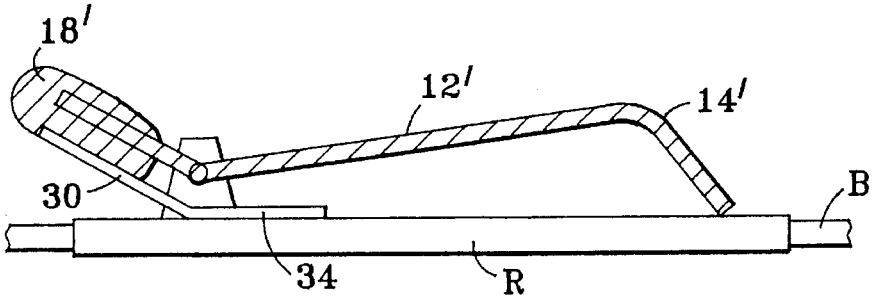
FIG. 3*b* shows a special construction with a holding-down device for the setting-up stirrup.

To achieve this additional object, it is proposed, according to the invention, to press the stirrup part or half-lug part 14 permanently against the plate R. This can take place in that, for example in FIG. 1, a spring 32, for example made of plastic, is injection-molded onto the tread part. A spring made of steel can be molded on or into the trend part in a similar way. The spring is angled, as seen in FIGS. 1 and 2, or rounded, as seen in FIGS. 3*a* and 3*b* in the part loosely touching the plate, that is to say consists of two legs, namely the leg parallel to the tread, tread spring leg 30 and the base spring leg 34 which is parallel to the horizontal plate R (FIG. 3*b*).

Another useful advantage of the invention is that it is possible to easily refit many currently available cleaning appliances to accommodate the feature of the invention without the need to make substantial changes to the plate portion. Existing holes in the plate portion of the appliance may be useful in attaching the setting-up stirrup by hinges 20. The means used for mounting the invention to already available appliances may be made of metal or plastic.

I claim:

1. In an improved cleaning appliance having a handle, means to attach said handle to a basic body portion, said basic body portion accommodates attaching thereto of materials used for cleaning, scrubbing and wiping, the improvement comprising:

said means to attach said handle to said basic body portion being a cardanic connection;

means for articulatably mounting and appropriately positioning a setting-up stirrup, said setting-up stirrup mounted on said basic body portion; and means for releasably engaging said mounted setting-up stirrup to said handle when said handle is substantially vertically directed relative to said basic body portion.

2. The improved cleaning appliance according to claim 1 further comprising means for articulating of said setting-up stirrup causing said releasable engagement of said handle with said setting-up stirrup and holding said handle substantially vertically directed.

3. The improved cleaning appliance according to claim 2 wherein said means for articulating of said setting-up stirrup comprises a tread on one side of said means for articulatably mounting and appropriately positioning said setting-up stirrup on said basic body portion, said one side being opposite from said means for releasably engaging said handle to said setting-up stirrup.

4. The improved cleaning appliance according to claim 3 wherein said means for releasably engaging said articulatably mounted and appropriately positioned setting-up stirrup to said handle comprises a half-lug for receiving said handle.

5. The improved cleaning appliance according to claim 4 wherein said half-lug of the setting-up stirrup is angled to provide a support for said handle when said handle is placed substantially horizontal relative to said basic body portion and engaged with said half-lug.

6. The improved cleaning appliance according to claim 5 wherein said setting-up stirrup further comprises two longitudinal stirrup sides contiguous with said half-lug and said means for articulating of said setting-up stirrup, and further comprising at least one spring element configured to urge each said two longitudinal stirrup sides against said basic body portion.

7. The improved cleaning appliance according to claim 6 wherein said setting-up stirrup having said two longitudinal stirrup sides, said half-lug and said means for articulating of said setting-up stirrup, each comprises stirrup wires and said means for articulating of said setting-up stirrup comprises at least one substantially round-shaped hook formed from at least one stirrup wire end at said one side opposite from said means for releasably engaging.

8. The improved cleaning appliance according to claim 3 further comprising at least one spring element configured to urge said tread away from said basic body portion.

9. The improved cleaning appliance according to claim 3 wherein said tread carries a plastic mass formed on said tread providing thereby a surface upon which an operator applies foot pressure causing said setting-up stirrup to engage said handle.

10. The improved cleaning appliance according to claim 9 further comprising at least one spring element configured to urge said tread away from said basic body portion, said at least one spring element formed contiguous with said plastic mass.

11. The improved cleaning appliance according to claim 1 wherein said means for releasably engaging said articulatably mounted and appropriately positioned setting-up stirrup to said handle comprises a half-lug for receiving said handle.

* * * * *